United States Patent [19]

Johnson

[11] Patent Number: 4,644,594

[45] Date of Patent: Feb. 24, 1987

[54] PATIENT TRANSPORT DEVICE

[76] Inventor: Roger A. Johnson, P.O. Box 78290, Shreveport, La. 71107

[21] Appl. No.: 726,430

[22] Filed: Apr. 24, 1985

[51] Int. Cl.[4] ..... A61G 1/02

[52] U.S. Cl. ..... 5/81 R; 5/428

[58] Field of Search ..... 5/81 R, 81 B, 86, 92, 5/425, 428, 429, 61

[56] References Cited

U.S. PATENT DOCUMENTS

| | | | |
|---|---|---|---|
| 758,493 | 4/1904 | Abbey | 5/81 B X |
| 1,876,922 | 9/1932 | Hamilton | 5/81 R X |
| 2,565,761 | 8/1951 | Dean | 5/86 |
| 2,691,782 | 10/1954 | West | 5/81 B |
| 3,786,523 | 1/1974 | Sele | 5/81 B |
| 3,962,736 | 6/1976 | Fedele | 5/81 R |
| 4,137,581 | 2/1979 | Daly | 5/81 B |
| 4,252,756 | 4/1981 | Pace | 5/81 B |

FOREIGN PATENT DOCUMENTS

| | | | |
|---|---|---|---|
| 2809526 | 9/1979 | Fed. Rep. of Germany | 5/81 R |
| 197867 | 6/1963 | U.S.S.R. | 5/81 B |

*Primary Examiner*—William F. Pate, III
*Assistant Examiner*—Rich Chilcot
*Attorney, Agent, or Firm*—John M. Harrison

[57] ABSTRACT

A patient transport device which is characterized in one embodiment by a flat rail bed having spaced, parallel, upturned rails on opposite sides, with a seat slidably disposed over the rails by means of rollers rotating in the rails on spaced axles carried by the seat. The device is designed to transport patients from one side of a bed to the other, as well as to and from wheelchairs and dollys. In another embodiment, the seat is enlarged to define a body support, the body support and rail bed combination is supported by hydraulic cylinders to facilitate height adjustment and the larger patient transport device is used to transport patients to and from x-ray tables, dollys, hospital beds and the like.

13 Claims, 7 Drawing Figures

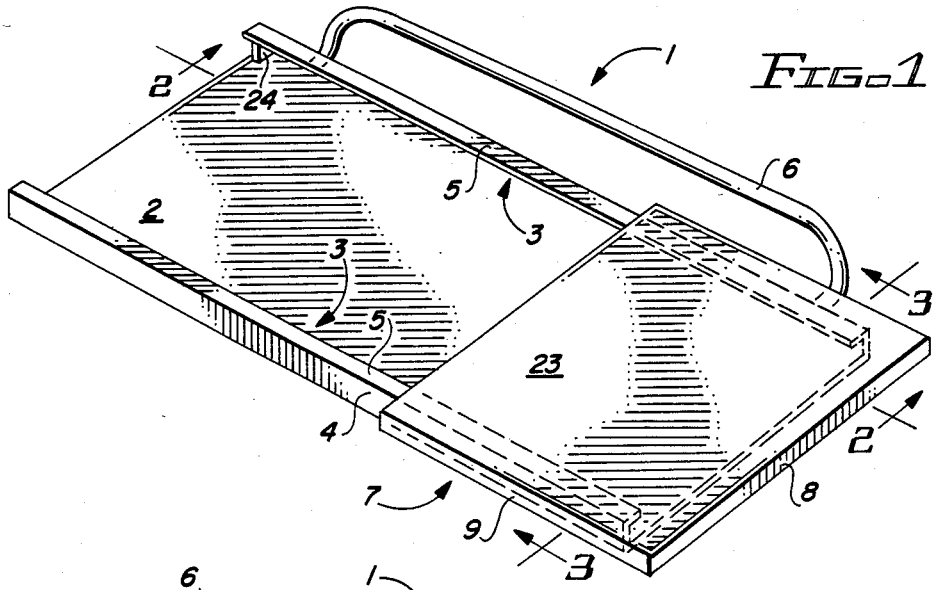
FIG. 1
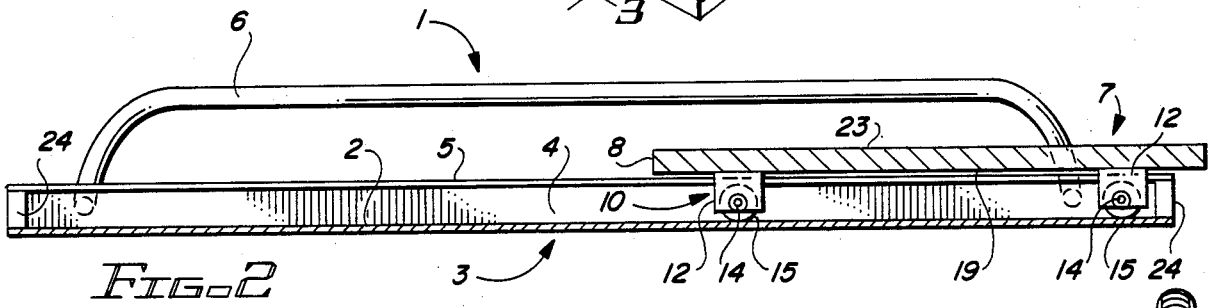
FIG. 2
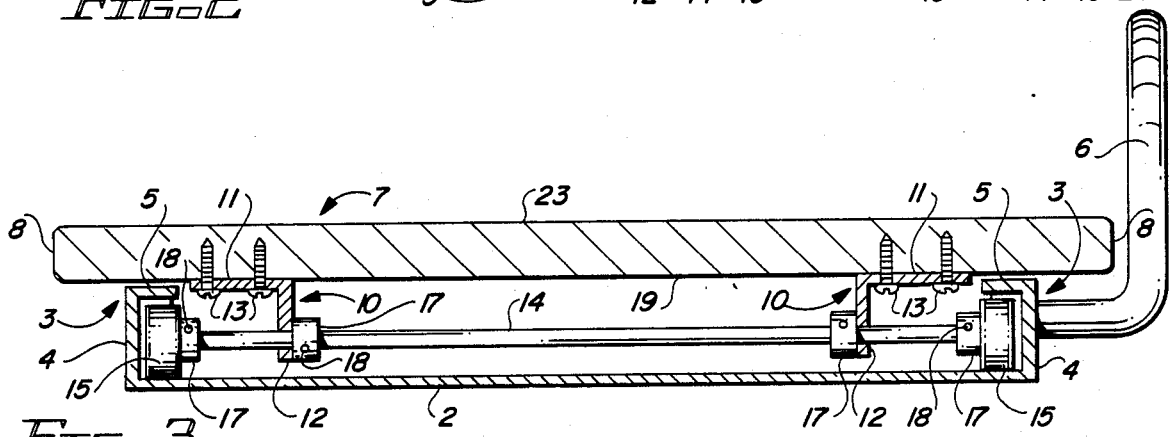
FIG. 3
FIG. 5
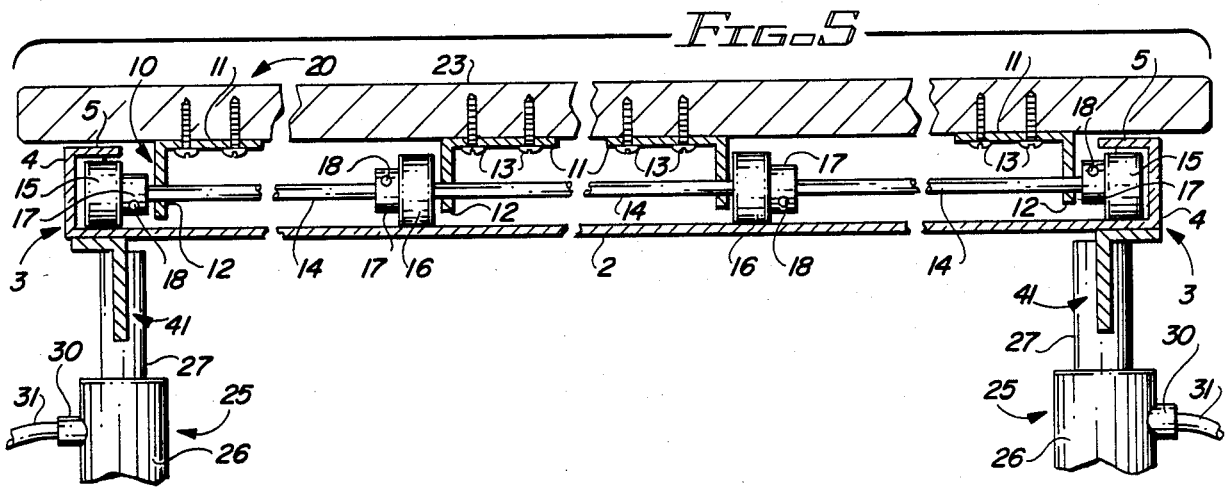

FIG. 4
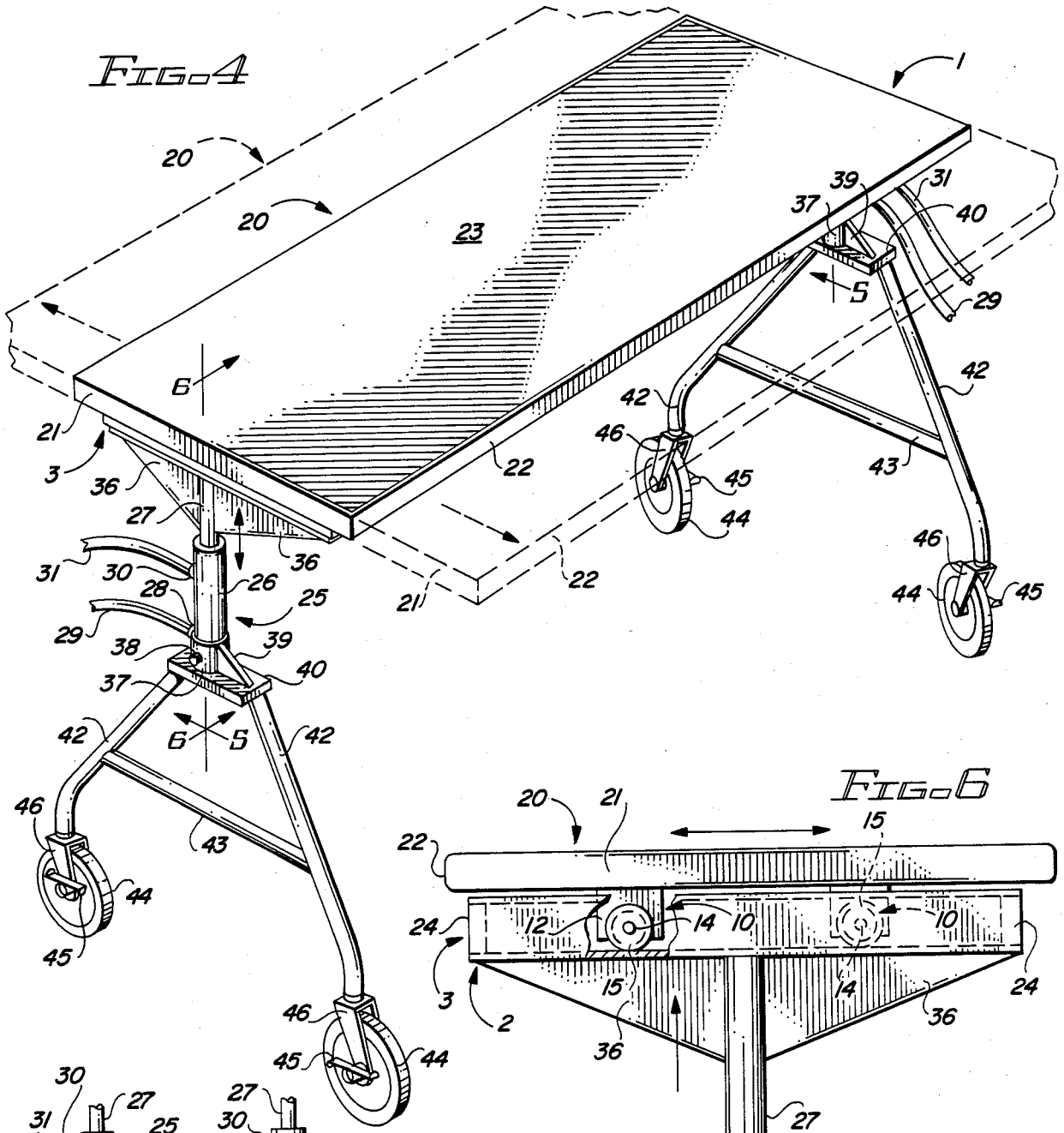
FIG. 6
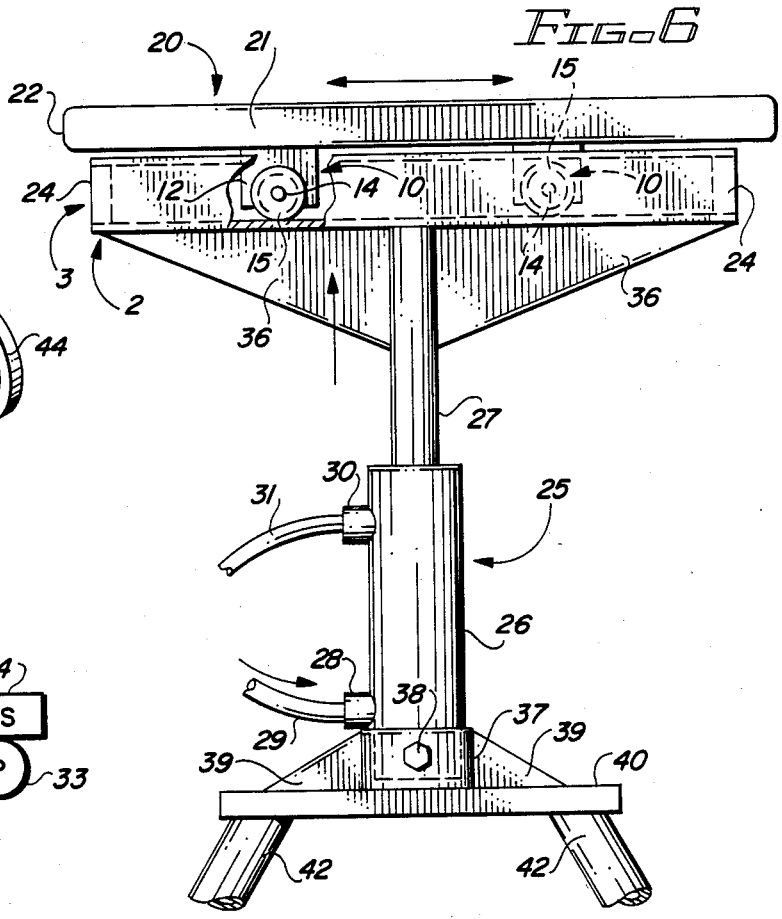
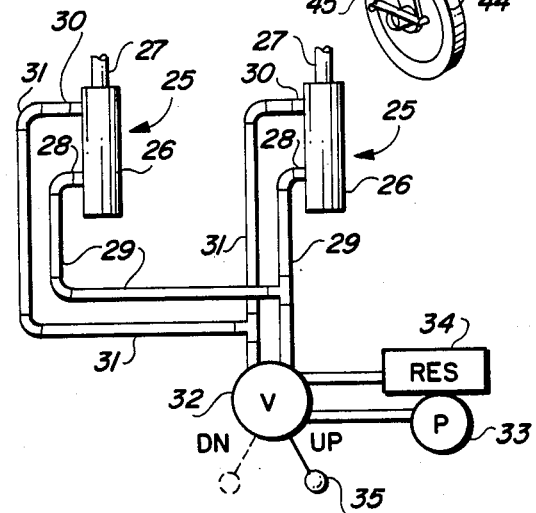
FIG. 7

PATIENT TRANSPORT DEVICE

BACKGROUND OF THE INVENTION

1. Field of the Invention

This invention relates to the moving and transportation of bedridden persons and patients in hospitals, homes and nursing homes and more particularly, to the transportation of patients from one location in a bed to another, from the bed to a wheelchair or dolly and back to the bed and from a dolly to an x-ray table or the like and back, as the case may require. The patient transport device includes, in a first preferred embodiment, a flat rail bed having spaced, parallel, upturned side rails which receive rollers carried by a seat or body support slidably positioned on the rail bed and designed to overlap and traverse the rail bed as the rollers traverse the rails. A hand support is provided as an optional feature and in a second preferred embodiment, the rail bed is longer and the seat or body support is larger to accommodate the entire body, in order to facilitate movement of persons in a prone position from one support plane to another. In a most preferred aspect of this embodiment of the invention, the rail bed is mounted on hydraulic cylinders to facilitate height adjustment of the body support.

2. Description of the Prior Art

The transportation of bedridden and sick patients in homes, nursing homes, hospitals and clinics from bed to wheelchair and back, or to a transportation dolly and from the dolly to an x-ray table and the like, is commonly done with the aid of several individuals and a blanket or sheet. This method is at best cumbersome, and is sometimes painful, particularly in the case of patients which have just returned from surgery and must be moved from ICU to a dolly, and then to a hospital bed. Considerable discomfort and pain can even be experienced when moving a person from one side of the bed to another, especially immediately following an injury or surgery.

U.S. Pat. No. 2,648,849, dated Aug. 18, 1953, to M. G. Webb et al, discloses an "Invalid Chair for Bathtubs". The device is characterized by a frame formed of a pair of horizontal rails extending transversely over the bathtub, a pair of vertical legs depending from the rail ends which extend outside of the bathtub, connecting bars joining the rails and the legs, a horizontal guide bar with the rails movably engaging the guide bar, a chair, rollers carried by the chair and movably engaging the rails and retaining means holding the chair against movement on the rails.

It is an object of this invention to provide a patient transport device which is characterized by a generally flat rail bed provided with upturned, parallel and spaced rails and a seat slidably disposed on the rail bed and carrying multiple rollers engaging the rails.

Another object of the invention is to provide a patient transport device which can be used in homes, hospitals, nursing homes and like institutions for transporting bedridden, injured and sick patients from one side of the bed to another or from the bed to a wheelchair or to and from other means of transportation such as a dolly, which patient transport device includes a rail bed provided with parallel, spaced, upturned rails and a seat having rollers mounted thereon, the rollers engaging the rails to facilitate slidable movement of the seat along the rail bed in either direction to support and move the patient.

Still another object of this invention is to provide a patient transport device which is designed to relocate a patient lying in a prone position, which device is characterized by a generally flat rail bed having spaced rails at the foot and head thereof and a cooperating supporting member provided with rollers at spaced intervals, with at least some of the rollers engaging the rails, such that the supporting member is slidably mounted on the rail bed for transporting the patient from a bed to a transport dolly, x-ray table or the like.

A still further object of the invention is to provide a device for slidably transporting persons in the seated or prone position from one point to another, which device includes a rail bed of selected size having spaced, generally parallel and upturned rails and a seat or body support of selected size slidably disposed on the rail bed and fitted with axles and cooperating rollers which engage the rails to facilitate sliding movement of the seat or body support from one side of the rail bed to the other.

Yet another object of the invention is to provide a patient transport device for transferring a patient from one point to another, which device includes a generally flat rail bed having spaced and generally parallel, upturned rails with a body support slidably positioned on the rail bed and carrying spaced axles with rollers engaging the rails and further including hydraulic cylinders supporting the rail bed for adjusting the height of the body support.

SUMMARY OF THE INVENTION

These and other objects of the invention are provided in a patient transport device which, in a preferred embodiment, is characterized by a generally flat rail bed having parallel, spaced, upturned rails and a seat which is slidably positioned on the rail bed and is provided with multiple rollers cooperating with the rails to facilitate sliding movement of the seat with respect to the rails. In another preferred embodiment, the seat is enlarged to define a body support and the rail bed is supported on a frame which includes hydraulic cylinders to facilitate height adjustment of the rail bed and the body support with respect to the floor.

BRIEF DESCRIPTION OF THE DRAWINGS

The invention will be better understood by reference to the accompanying drawings, wherein:

FIG. 1 is a perspective view of a first preferred embodiment of the patient transport device of this invention;

FIG. 2 is a sectional view, taken along line 2—2 of the patient transport device illustrated in FIG. 1;

FIG. 3 is a sectional view, taken along line 3—3 of the patient transport device illustrated in FIG. 1;

FIG. 4 is a perspective view of a second preferred embodiment of the patient transport device of this invention;

FIG. 5 is a sectional view, taken along line 5—5 of the patient transport device illustrated in FIG. 4;

FIG. 6 is sectional view, taken along line 6—6 of the patient transport device illustrated in FIG. 4; and FIG. 7 is a schematic of a hydraulic system used to adjust the height of the patient transport device illustrated in FIG. 4.

DESCRIPTION OF THE PREFERRED EMBODIMENTS

Referring initially to FIGS. 1–3 of the drawings, in a preferred embodiment of the invention the patient transport device is illustrated by reference numeral 1. The patient transport device 1 includes a generally flat rail bed 2, having oppositely disposed, spaced and upward standing rails 3 on both sides thereof. Each of the rails 3 is characterized by a rail side 4, which extends upwardly from the rail bed 2 and an inwardly extending rail flange 5. Accordingly, it will be appreciated that each of the rails 3 defines an inwardly facing channel and in a most preferred embodiment of the invention, the rails 3 are formed integrally with the rail bed 2, according to the knowledge of those skilled in the art. In a preferred embodiment of the invention, a hand support 6 extends from the rail side 4 of one of the rails 3 and spans a portion of the length of the rail bed 2, as illustrated in FIGS. 2 and 3. A seat is generally illustrated by reference numeral 7 and is disposed over the rail bed 2. In another preferred embodiment of the invention, the seat 7 is either square or rectangular in configuration and is characterized by parallel seat ends 8, parallel seat sides 9 and a generally flat bottom surface 19 and upper surface 23. The seat 7 is further fitted with two sets of axle mount brackets 10, each of which are disposed in spaced relationship with respect to each other, as illustrated in FIGS. 2 and 3. A pair of axles 14 extend through the axle flanges 12, respectively, of corresponding sets of the axle mount brackets 10, while the seat flange 11 of each of the axle mount brackets 10 lies flat against the bottom surface 19 of the seat 7 and is attached to the seat 7 by means of fasteners 13. It will be appreciated that the seat 7 can be manufactured of a variety materials, including wood, fiberglass, plastic and stainless steel, in non-exclusive particular. However, in a preferred embodiment of the invention, the seat 7 is constructed of stainless steel and the fasteners 13 are characterized by metal screws which extend through apertures (not illustrated) in the seat flanges 11 of the axle mount brackets 10, respectively, to attach the axle mount brackets 10 securely to the seat 7. In another most preferred embodiment of the invention and as further illustrated in FIGS. 1–3, the seat ends 8 of the seat 7 overhang each end of the rail bed 2 when the seat 7 is located at the extreme ends of the rail bed 2, respectively, while the seat sides 9 likewise overhang the rails 3, for purposes which will be hereinafter described. A pair of outside rollers 15 are rotatably mounted on opposite ends of each of the axles 14, as illustrated in FIGS. 2 and 3 and multiple clamps 17, fitted with allen screws 18, serve to prevent the outside rollers 15 from moving inwardly on the axles 14 and exiting the channels formed by the rail side 4, rail flange 5 and the rail bed 2, respectively. Additional clamps 17 are secured to the axles 14 adjacent the respective axle flanges 12 and serve to prevent the axles 14 from sliding in the axle flanges 12, in order to further insure that each set of outside rollers 15 traverse the rails 3 smoothly and evenly as the seat 7 traverses the rail bed 2 from end to end. Roller stops 24 are secured to the ends of each of the rails 3, in order to limit the travel of the outside rollers 15 and the seat 7, as illustrated in FIGS. 1 and 2. Accordingly, it will be appreciated from a consideration of FIGS. 1–3 that the seat 7 is able to traverse the entire length of the rail bed 2 with the seat ends 8 overhanging the open ends of the rail bed 2, respectively, as each corresponding set of outside rollers 15 contacts the respective roller stops 24, mounted at the ends of the rails 3. Thus, the overhang of the seat ends 8 and the seat sides 9 is designed to prevent pinching or cutting a patient who is seated on the seat 7.

Referring now to FIGS. 4–6 of the drawings, in another preferred embodiment of the invention the patient transport device 1 is characterized by a larger rail bed 2, fitted with rails 3 which are designed in the same manner as the rails 3 illustrated in FIGS. 1–3, except that the rails 3 in this embodiment of the invention are spaced farther apart than those illustrated in FIGS. 1–3. A body support 20 is designed to support a patient in a prone position and serves as a counterpart to the seat 7 in the FIG. 1–3 embodiment of the invention. The body support 20 is defined by body support ends 21, which overlap the rails 3, provided in the the rail bed 2 and by body support sides 22, which overlap corresponding open ends of the rail bed 2. As in the case of the upper surface 23 of the seat 7, the upper surface 23 of the body support 20 is generally flat and the respective sets of outside rollers 15 are supported on spaces axles 14, carried by the axle flanges 12 of the respective axle mount brackets 10, in the same manner as the patient transport device illustrated in FIGS. 1–3. The body support 20 is additionally fitted with inside rollers 16, which are secured to the axles 14, carried by additional axle mount brackets 10, as illustrated in FIG. 5. Each of the axle mount brackets 10 is characterized by a seat flange 11, secured by means of fasteners 13 to the bottom surface 19 of the body support 20, and an axle flange 12 carring an axle 14. The spaced axles 14 are stabilized in the respective axle flanges 12 by means of additional clamps 17, which are fitted with allen screws 18, in the same manner as the patient transport device 1 illustrated in FIGS. 1–3. Accordingly, it will be appreciated that each set of outside rollers 15 are constrained to remain inside the rails 3, respectively, while the inside rollers 16 traverse the rail bed 2 at points inwardly of the rails 3, in order to support the entire span of the body support 20.

In a most preferred embodiment of the invention and referring now to FIGS. 4–7 of the drawings, a pair of hydraulic cylinders are generally illustrated by reference numeral 25 and are positioned at opposite ends of the rail bed 2. The hydraulic cylinders 25 are fitted with pistons 27, respectively, the free ends of which pistons 27 are secured to the rail bed 2 by means of piston brackets 41. The pistons 27 cooperate with the cylinders 26 in conventional fashion and a pair of piston webs 36 extend from each piston 27 along opposite ends of the rail bed 2 as illustrated, in order to further stabilize the rail bed 2 and the body support 20 on each piston 27. A cylinder base 37 supports each cylinder 26 and cooperating piston 27 and is fitted with a fill plug 38, for charging the hydraulic cylinders 25 with hydraulic fluid. An inlet nipple 28 and outlet nipple 30 are provided in spaced relationship on each of the cylinders 26 and cooperate with an inlet line 29 and an outlet line 31, respectively, in order to apply and release pressure in the respective cylinders 26 and raise and lower the pistons 27, rail bed 2 and body support 20, as deemed necessary. As illustrated in FIG. 7, the inlet lines 29 and outlet lines 31 communicate with a valve 32, which receives a control lever 35 and is positioned in cooperation with a pump 33 and a reservoir 34, in order to control the flow of hydraulic fluid to and from each of the cylinders 26 of the hydraulic cylinders 25, as hereinafter described. Base webs 39 serve to stabilize each hydraulic cylinder base 37 securely on a base plate 40, which is supported by a pair of legs 42, spanned by a brace 43. In a most preferred embodiment of the invention a set of wheels 44 is provided on wheel brackets 46, mounted on the opposite extending ends of each set of legs 42 and conventional wheel stops 45 are provided on the wheels 44, in order to stabilize the patient transport device 1 in a selected location.

In operation, and referring again to FIGS. 1–3 of the drawings, the patient transport device 1 of this embodiment of the invention is used primarily to move a patient from one side of a bed to another or from a bed to a wheelchair and back into the bed, and for similar patient relocation. Typically, while a patient is sitting on the bed, the patient transport device 1 is inserted beneath the legs and pelvic area, with the buttocks resting on the seat 7 and the seat 7 is moved to the appropriate position on the rail bed 2 in order to move the patient. Accordingly, the patient can be moved either laterally or longitudinally on a bed, or from the bed to a dolly or wheelchair with minimum effort and with the help of only one other person.

Referring again to FIGS. 4–7 of the drawings, the patient transport device of this embodiment is used primarily to transfer patients to and from a bed to a dolly and from the dolly to x-ray table and back, under circumstances where the patient must remain in the prone position. Under these circumstances, the patient is first moved from the center of the bed by conventional techniques or by use of the patient transport device illustrated in FIGS. 1–3, depending upon his or her condition. When the patient is lying on the edge of the bed, the patient transport device illustrated in FIGS. 4–7 is adjusted in height by operating the hydraulic cylinders 25 until the upper surface 23 of the body support 20 is slightly above the level of the bed. The patient transport device 1 is then positioned close to the bed and the body support 20 is situated with one of the body support sides 22 projected beneath the patient and fully extended on the rails 3. The wheel stops 45 are then manipulated to prevent the wheels 44 from rolling and the patient is gently urged farther onto the body support 20, which is then slidably adjusted on the rails 3 away from the bed. The wheel stops 45 are then unlocked and the patient is delivered to the desired location. Unloading of the patient is effected by aligning the body support 20 slightly above the level of the receiving surface by manipulating the control lever 35 and adjusting the hydraulic cylinders 25. One of the body support sides 22 is then manipulated over the receiving surface and the patient is gently transferred to the receiving surface by sliding the body support 20 from beneath him.

Referring again to FIG. 7 of the drawings, it will be appreciated that the hydraulic cylinders 25 are operated in conventional manner to raise and lower the rail bed 2 and body support 20 in the patient transport device 1 embodied in FIGS. 4–6. For example, under circumstances where the rail bed 2 and body support 20 are to be raised, the control lever 35 is pivoted to the "up" position to force hydraulic fluid from the reservoir 34 through the valve 32 and the inlet lines 29 into the cylinders 26. This action occurs by operation of the pump 33 and causes the pistons 27 to extend from the cylinders 25. The rail bed 2 and body support 20 are lowered by manipulating the control lever 35 in the opposite direction to the "down" position, to cause hydraulic fluid to flow from the cylinders 26 through the outlet line 31 and the valve 32, back into the reservoir 34. This action reduces the hydraulic pressure in the cylinders 26 and allows the pistons 27 to retract in the cylinders 26. It is understood that while a hydraulic system is illustrated in the drawings for raising and lowering the rail bed 2 and body support 20, other means, including mechanical jacking means and air cylinders, can be used, in non-exclusive particular.

It will be further appreciated that in the course of providing outside rollers 15 and inside rollers 16 which roll in the rails 3 to facilitate smooth sliding of the seat 7 and body support 20, the outside rollers 15 and inside rollers 16 can be adapted for rotation on the axles 14 or the axles 14 can be adapted to rotate with respect to the respective axle flanges 12. In the former case, bearings (not illustrated) are preferably provided in the outside rollers 15 and inside rollers 16 and in the latter case, both the outside rollers 15 and inside rollers 16 are secured to the respective axles 14.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A device for moving a patient to and from a bed comprising:

(a) a generally flat rail bed;

(b) a pair of rails carried by said rail bed in spaced, general parallel relationship, said rails each having an upward standing rail side extending from an opposite edge of said rail bed and a rail flange projecting inwardly of said rail bed in facing relationship to define a pair of spaced, facing channel members;

(c) a support positioned over said rail bed and said rails, with the sides of said support extending beyond said rails;

(d) A plurality of L-shaped brackets carried by said support in spaced relationship;

(e) A pair of axles rotatably carried by said brackets, said axles extending between said rails; and (f) At least two rollers rotatably mounted on each of said axles, said rollers located between said rail flange and said rail bed and lying adjacent said rail side in said rails, respectively, whereby said rollers are constrained to traverse said rails when said support traverses said rail bed.

2. The device of claim 1 further comprising a hand grip carried by said rail side and extending above the plane of said support substantially along the length of said support.

3. The device of claim 1 further comprising clamp means secured to each of said axles adjacent said rollers, whereby said rollers are prevented from moving laterally along said axles away from said rails.

4. The device of claim 1 further comprising:

(a) A hand grip carried by said rail side and extending above the plane of said support substantially along the length of said support; and (b) clamp means secured to each of said axles adjacent said rollers, whereby said rollers are prevented from moving laterally along said axles away from said rails.

5. The device of claim 4 wherein said clamp means is further characterized by a plurality of round clamps encircling said axles and allen screws threaded in said clamps for engagement with said axles and securing said clamps on said axles.

6. The device of claim 1 wherein said at least two rollers is four rollers, with a first two of said rollers mounted on the ends of said axles between said rail flange and said rail bed and lying adjacent said rail side in said rails, respectively, and a second two of said rollers mounted in spaced relationship on each of said axles, respectively, inwardly of said first two of said rollers.

7. The device of claim 6 further comprising clamp means secured to each of said axles adjacent said first two of said rollers and said second two of said rollers, whereby said first two of said rollers and said second two of said rollers are prevented from moving laterally along said axles.

8. The device of claim 7 wherein said clamp means is further characterized by a plurality of round clamps encircling said axles and allen screws threaded in said clamps for engagement with said axles and securing said clamps on said axles.

9. The device of claim 1 further comprising fluid cylinder means supporting said rail bed for adjusting the height of said rail bed and said support.

10. The device of claim 9 further comprising clamp means secured to each of said axles adjacent said rollers, whereby said rollers are prevented from moving laterally along said axles away from said rails.

11. The device of claim 9 wherein said at least two rollers is four rollers, with a first two of said rollers mounted on the ends of said axles between said rail flange and said rail bed and lying adjacent said rail side in said rails, respectively, and a second two of said rollers mounted in spaced relationship on each of said axles, respectively, inwardly of said first two of said rollers.

12. The device of claim 9 wherein said at least two rollers is four rollers, with a first two of said rollers mounted on the ends of said axles between said rail flange and said rail bed and lying adjacent said rail side in said rails, respectively, and a second two of said rollers mounted in spaced relationship on each of said axles, respectively, inwardly of said first two of said rollers and further comprising clamp means secured to each of said axles adjacent said first two of said rollers and said second two of said rollers, whereby said first two of said rollers and said second two of said rollers are prevented from moving laterally along said axles.

13. The device of claim 12 wherein said clamp means is further characterized by a plurality of round clamps encircling said axles and allen screws threaded in said clamps for engagement with said axles and securing said clamps on said axles.

* * * * *